US012736243B2

(12) United States Patent
Coogan

(10) Patent No.: US 12,736,243 B2
(45) Date of Patent: Sep. 15, 2026

(54) DETERMINING RESTORATION TIMES OF COMFORT CONDITIONS

(71) Applicant: Siemens Industry, Inc., Alpharetta,, GA (US)

(72) Inventor: James Coogan, Des Plaines, IL (US)

(73) Assignee: Siemens Industry, Inc., Alpharetta, GA (US)

( * ) Notice: Subject to any disclaimer, the term of this patent is extended or adjusted under 35 U.S.C. 154(b) by 399 days.

(21) Appl. No.: 18/454,437

(22) Filed: Aug. 23, 2023

(65) Prior Publication Data

US 2025/0067456 A1 Feb. 27, 2025

(51) Int. Cl.

*F24F 11/56* (2018.01)
*F24F 11/49* (2018.01)
*F24F 11/64* (2018.01)

(52) U.S. Cl.

CPC ..... *F24F 11/56* (2018.01); *F24F 11/49* (2018.01)

(58) Field of Classification Search

CPC .. F24F 11/56; F24F 11/49; F24F 11/64; F24F 2110/10; G05D 23/1917; G05D 23/1934
USPC ..... 700/276
See application file for complete search history.

(56) References Cited

U.S. PATENT DOCUMENTS

2019/0017720 A1* 1/2019 Otsuki ..... F24F 11/65
2020/0025402 A1 1/2020 Bell et al.
2023/0160596 A1* 5/2023 Elbsat ..... F24F 11/83 700/276

OTHER PUBLICATIONS

Hu Jianjun et al; "A state-space modeling approach and multi-level optimization algorithm for predictive control of multi-zone buildings with mixed-mode cooling"; Building and Environment; Pergamon Press; Oxford, GB; vol. 80; May 21, 2014; (May 21, 2014); pp. 259-273; XP029036159; ISSN: 0360-1323; DOI:10.1016/J.BUILDENV.2014.05.003;p. 265; Table 2; figure 5.

Katona, Selah, "Can AI Make Our Buildings More Sustainable?", University of Toronto, U of T News, May 29, 2023, https://www.utoronto.ca/news/can-ai-help-make-our-buildings-more-sustainable, 5 pages.

* cited by examiner

*Primary Examiner* — Michael J Brown

(57) ABSTRACT

Systems, methods, and/or mediums determine restoration times of comfort conditions. Zone temperatures for multiple zones of a facility are received. A heat transfer characteristic between a first and second zones is identified in which the second zone located adjacent to the first zone. A start time for a zone temperature action for the first zone is determined based on a first zone temperature of the first zone, a second zone temperature of the second zone, and the heat transfer characteristic. A zone command is sent to a temperature control system of the facility in which the zone command includes the start time of the zone temperature action for the first zone.

20 Claims, 7 Drawing Sheets

DETERMINING RESTORATION TIMES OF COMFORT CONDITIONS

FIELD OF THE INVENTION

This application relates to the field of building management systems and, more particularly, to managing comfort conditions for a multiroom building.

BACKGROUND

Building management systems encompass a wide variety of systems that aid in the monitoring and control of various aspects of building operation, particularly environmental or comfort conditions such as heating, ventilation, and air conditioning ("HVAC"). The elements of a building management system may be widely dispersed throughout a facility or campus. For example, the system may include sensors, actuators, controllers, and control stations to manage an HVAC system having heaters, coolers, fans, ducts, pipes, dampers, and valves that are located within a building. The different areas of a building may have different environmental settings based upon the use and personal preferences of the occupants.

Energy in a building is conserved by allowing the temperature of a space to drift out of comfort range when the space is not in use. It takes time for the temperature to return to a comfortable level, i.e., warm up or cool down, when people start to occupy the space again. The time needed to restore comfort conditions is estimated based on the temperature of the space, the temperature external to the building, and the thermal characteristics of the space. This approach neglects the influence of other temperatures relevant to managing the comfort conditions, such as other environmental conditions within the building. Consequently, restore times lack precision so warm up/cool down operations of the space are inefficient.

Conventional features of building management systems attempt to produce comfort conditions but still lack optimal precision. A night setback feature allows a building to cool during unoccupied periods to conserve energy. A warmup feature brings a building, which has been allowed to cool, back up to conditions desired for occupied periods. An optimum start feature starts the warmup process as late as possible, while reaching the desired temperature for occupancy in time for scheduled for occupancy. The optimum start accounts for quantitative aspects of the heating system and the thermal process of warming the space. An adaptive optimum start feature observes the performance of the warmup process over time and automatically adjusts parameters based on observed performance to improve future performance.

For conventional systems, environmental data corresponding to connected spaces are grouped together, i.e., the individual storage levels of thermal energy are lumped as one. For example, the thermal states may be represented by one temperature value. This simple approach does not optimize restoration times for comfort conditions on a finer scale.

SUMMARY

In accordance with one embodiment of the disclosure, there is provided a connected space approach to determining restoration times of comfort conditions for building management systems. The approach considers heat transfer between connected space to determine the appropriate time to restore comfort conditions of an area. The approach, which may be analytical or utilize machine learning, effectively accounts for heat transfer between connected spaces to calculate a set of separate start times for the individual zones.

One aspect is a building management system for determining restoration times of comfort conditions comprising an input component, a processor coupled directly or indirectly to the input component, and an output component coupled directly or indirectly to the processor. The input component receives multiple zone temperatures for multiple zones of a facility in which the zones include a first zone and a second zone adjacent to the first zone. The processor identifies a heat transfer characteristic between first and second zones. The processor determines a start time for a zone temperature action for the first zone based on a first zone temperature of the first zone, a second zone temperature of the second zone, and the heat transfer characteristic. The output component sends a zone command to a temperature control system of the facility in which the zone command includes the start time of the zone temperature action for the first zone.

Another aspect is a method for determining restoration times of comfort conditions. Zone temperatures for multiple zones of a facility are received in which the zones include a first zone and a second zone adjacent to the first zone. A heat transfer characteristic between first and second zones is identified. A start time for a zone temperature action for the first zone is determined based on a first zone temperature of the first zone, a second zone temperature of the second zone, and the heat transfer characteristic. A zone command is sent to a temperature control system of the facility in which the zone command includes the start time of the zone temperature action for the first zone.

Yet another aspect is a building management system for determining restoration times of comfort conditions comprising an input component, a processor coupled directly or indirectly to the input component, and an output component coupled directly or indirectly to the processor. The input component receives multiple zone temperatures for multiple zones of a facility in which the zones include a first zone and a second zone adjacent to the first zone. The processor determines a start time for a zone temperature action for the first zone based on a first zone temperature of the first zone, a second zone temperature of the second zone, and a heat transfer characteristic between the first and second zones. The output component sends a zone command to a temperature control system of the facility in which the zone command includes the start time of the zone temperature action for the first zone.

Still another aspect is a method for determining restoration times of comfort conditions. Zone temperatures for multiple zones of a facility are received in which the zones include a first zone and a second zone adjacent to the first zone. A start time for a zone temperature action for the first zone is determined based on a first zone temperature of the first zone, a second zone temperature of the second zone, and a heat transfer characteristic between the first and second zones. A zone command is sent to a temperature control system of the facility in which the zone command includes the start time of the zone temperature action for the first zone.

The above-described features and advantages, as well as others, will become more readily apparent to those of ordinary skill in the art by reference to the following detailed description and accompanying drawings. While it would be desirable to provide one or more of these or other advantageous features, the teachings disclosed herein extend to those embodiments which fall within the scope of the appended claims, regardless of whether they accomplish one or more of the above-mentioned advantages.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects.

DETAILED DESCRIPTION

Figure 1:
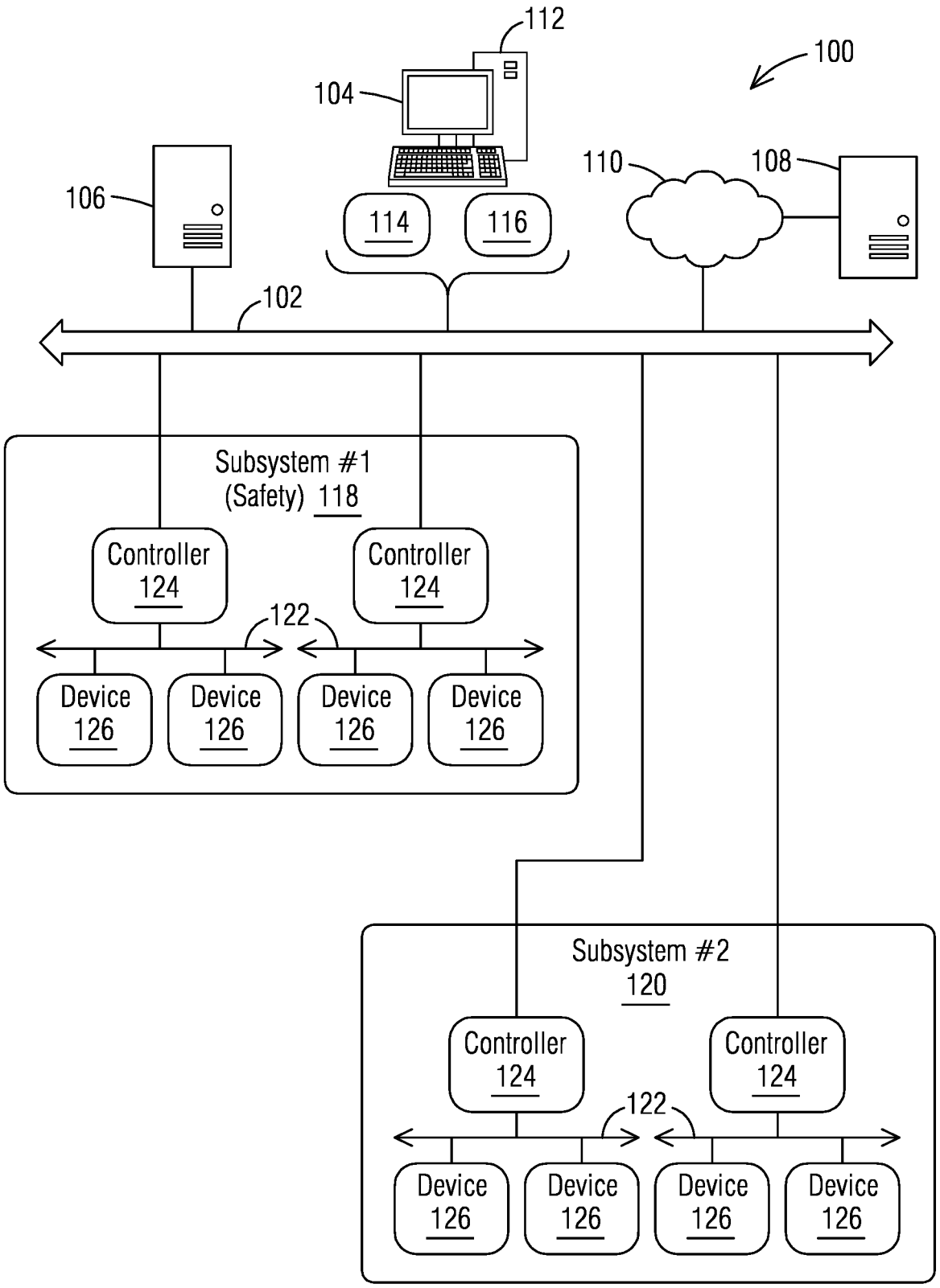
FIG. 1 is a system diagram of a building management system in an example implementation that is operable to employ techniques described herein.

Various technologies that pertain to systems and methods that facilitate determination of restoration times for comfort conditions will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

Referring to FIG. 1, there is shown a block diagram of the building management system ("BMS" or "system") 100 in an example implementation for the environment. The system 100 comprises one or more network connections or primary buses 102 for connectivity to components of a management level network ("MLN") of the system 100. For one embodiment, the example system 100 may comprise one or more management level devices or management devices, such as a management workstation 104, a management server 106, or a remote management device 108 connecting through a wired or wireless network 110, that allows the setting and/or changing of various controls of the system. A management device may also be a portable management device connecting through a wired or wireless link to an individual automation or field level device of the system 100. While a brief description of the system 100 is provided below, it will be understood that the system described herein is only one example of a particular form or configuration for a system. The system 100 may be implemented in any other suitable manner without departing from the scope of this disclosure. The management devices are configured to provide overall control and monitoring of automation devices, field devices, and other devices of the system 100.

One or more management devices of the system 100 includes one or more processors 112, one or more input components 114, and one or more output components 116. These components of the management device or devices allow for determination of restoration times for comfort conditions for the system 100.

For the illustrated embodiment of FIG. 1, the system 100 provides connectivity based on one or more communication protocols to subsystems for various building parameters, such as components of environmental comfort, fire safety, and security systems. Each subsystem 118, 120 may include various types of automation controllers and field devices 124, 126 ("automation controllers") for monitoring and controlling areas within a building or group of buildings. Examples of automation controllers and field devices 124, 126 include, but are not limited to, actuators, field panels, sensors, third-party devices, and the like. These automation controllers and field devices 124, 126 may communicate via one or more communication protocols, such as BACnet, KNX, Lon Works, Modbus, and the like.

Figure 2:
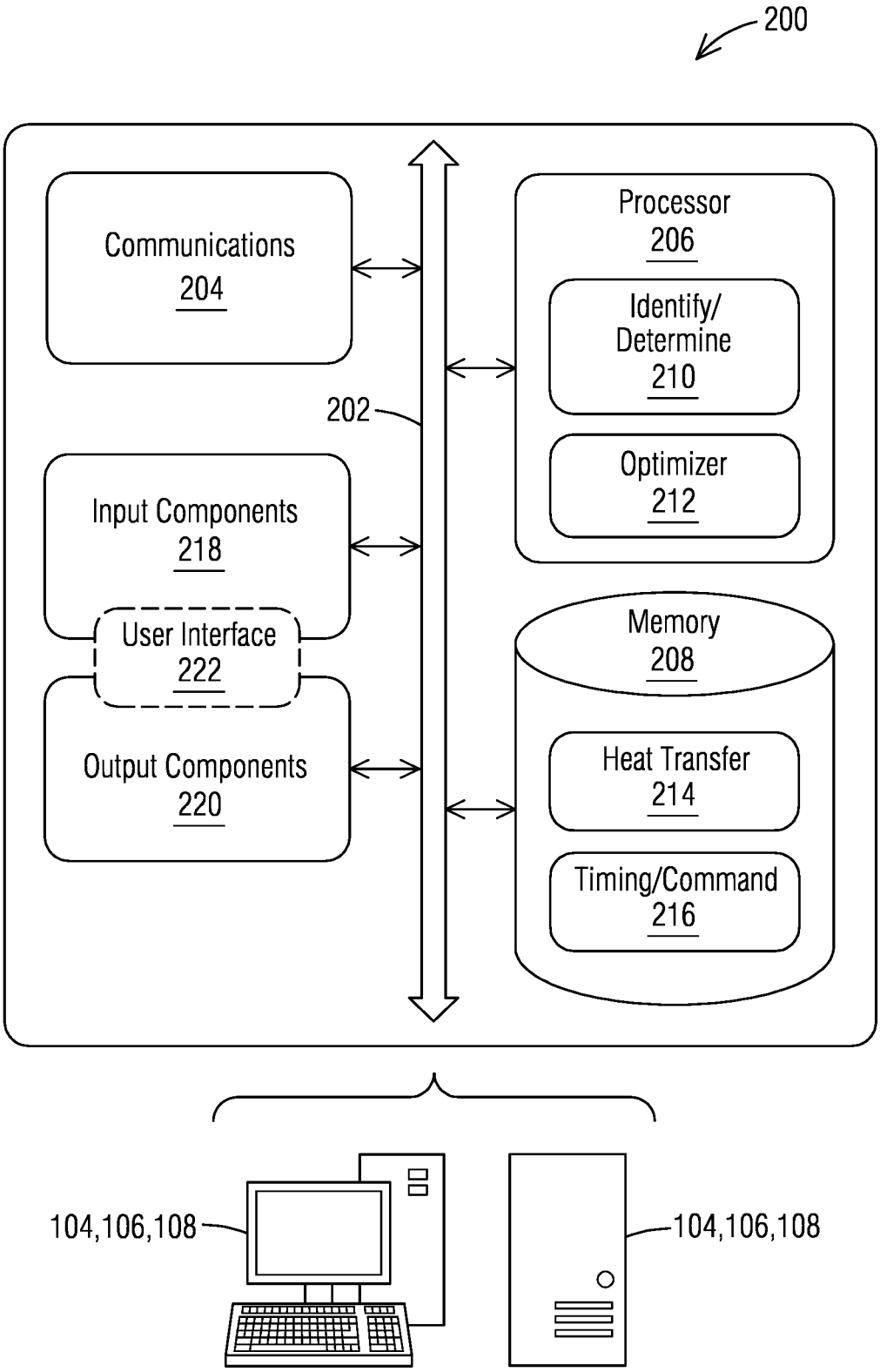
FIG. 2 is a block diagram of an example management device of FIG. 1 for determining restoration times of comfort conditions.

Referring to FIG. 2, there is shown example components 200 of a management device 104, 106, 108 for determining restoration times of comfort conditions. The device components 200 comprise one or more communication lines 202 for interconnecting other device components directly or indirectly. The other device components include one or more communication components 204 communicating with other entities via a wired or wireless network, one or more processors 206, and one or more memory components 208. The communication component 204 communicates (i.e., receives and/or transmits) data associated with one or more devices of the system 100 and its associated devices, such as the controllers and devices 124, 126. The communication component 204 may utilize wired or wireless technology for communication. Examples of wireless communication technologies include, but are not limited to, Bluetooth (including BLE), ultrawide band (UWB), Wi-Fi (including Wi-Fi Direct), Zigbee, cellular, mesh networks, PAN, WPAN, WAN, near-field communications, and other types of radio communications and their variants.

The processor or processors 206 may send data to, and process commands received from, other components of the device components 200, such as information of the communication component 204 or the memory component 208. Each application includes executable code to provide specific functionality for the processor 206 and/or remaining components of the management device 104, 106, 108. Examples of applications executable by the processor 206 include, but are not limited to, an identify and determine module 210 and an optimizer module 212. The identify/determine module 210 of the processor 206 identifies or determines a heat transfer characteristic between pairs of adjacent zones. The identify/determine module 210 also determines start times for a zone temperature action for a particular zone based on a temperature of the particular zone, temperature(s) of one or more zones adjacent to the particular zone, and heat transfer characteristics for each pair of zones. The optimizer module 212 of the processor 206 may include statistical models to analyze and draw inferences from patterns in data. Examples of technologies utilized by the optimizer module 212 includes, but are not limited to, an artificial neural network or a random forest of decision trees.

Data stored at the memory component 208 is information that may be referenced and/or manipulated by a module of the processor 206 for performing functions of the management device 104, 106, 108. Examples of data associated with the management device 104, 106, 108 and stored by the memory component 208 may include, but are not limited to, time series data of zone temperatures, heat transfer characteristics 214 and timing/command data 216. The heat transfer characteristics 214 are identified between pairs of adjacent zones and correlate to impact of adjacent heat to a particular zone. The timing/command data 216 includes a start time for a zone temperature action and a zone command to a temperature control system of a facility. The start time is determined based on a particular zone, one or more zone adjacent to the particular zone, and the heat transfer characteristics associated with each pair of zones. The zone command includes the start time of the zone temperature action for the particular zone.

The device components 200 may include an input component 218 that manages one or more input components and/or an output component 220 that manages one or more output components. The input components 218 and output components 220 of the device components 200 may include one or more visual, audio, mechanical, and/or other components. For some embodiments, the input and output components 318, 320 may include a user interface 322 for interaction with a user of the device. The user interface 322 may include a combination of hardware and software to provide a user with a desired user experience.

It is to be understood that FIG. 2 is provided for illustrative purposes only to represent an example implementation of the management device 104, 106, 108 and is not intended to be a complete diagram of the various components that may be utilized by the device. The management device 104, 106, 108 may include various other components not shown in FIG. 2, may include a combination of two or more components, or a division of a particular component into two or more separate components, and still be within the scope of the present invention. Also, the components 200 may be coupled directly or indirectly to each other to perform the operations of the management device 104, 106, 108. For example, the processor 206 may be coupled, directly or indirectly, to the input component 218. Likewise, the output component 220 may be coupled, directly or indirectly, to the processor 206.

Figure 3:
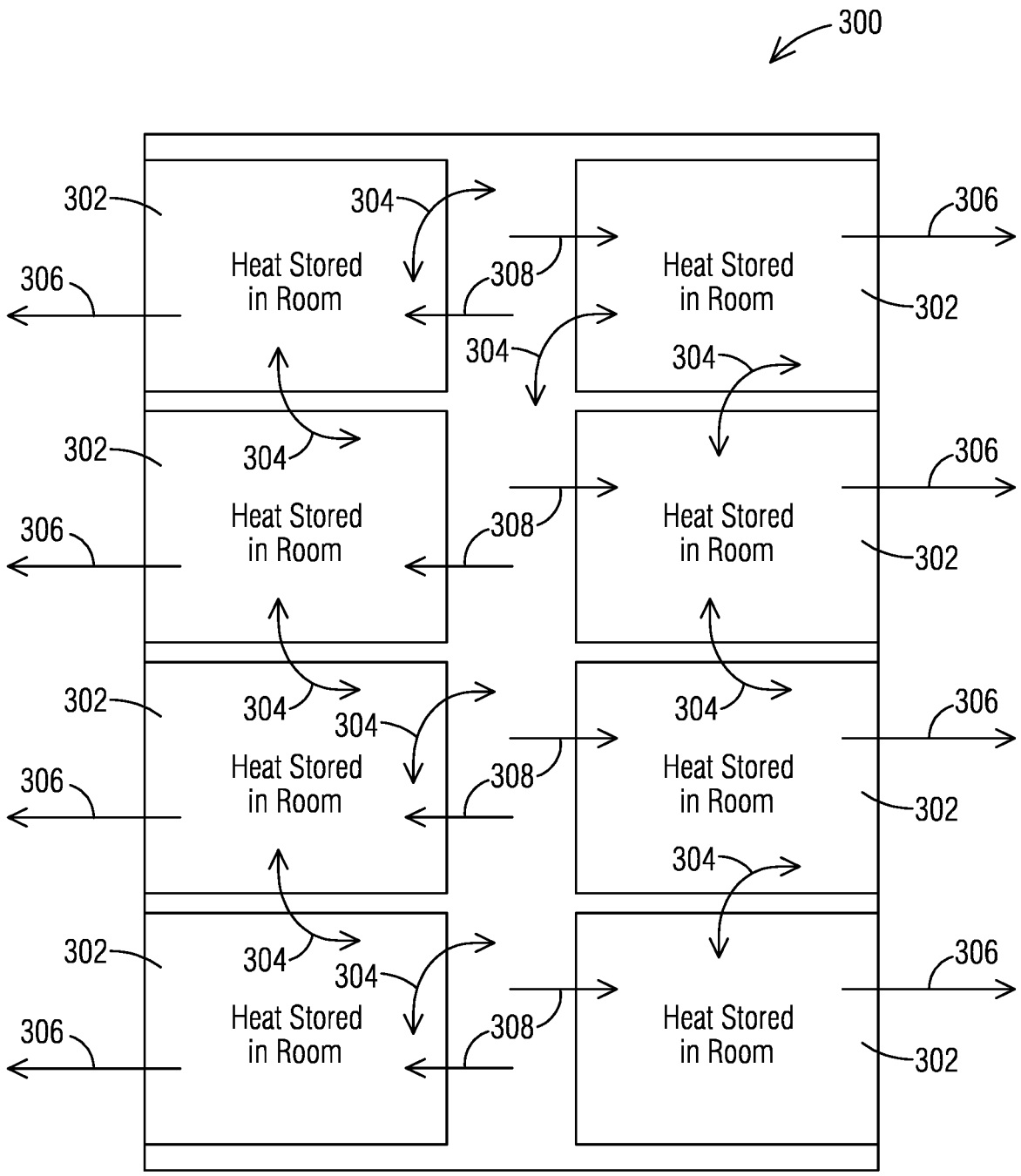
FIG. 3 is an illustration a building environment in an example implementation that is operable to employ techniques for determining restoration times of comfort conditions.

Referring to FIG. 3 is an illustration a building environment 300 in an example implementation that is operable to employ techniques for determining restoration times of comfort conditions. For the building environment 300, The system 100 controls an environment, such as a temperature, for multiple zones 302 of a facility. For example, the system 100 may control the temperature of each zone of the multiple zones 302 individually. The system may optimize a start time for a zone temperature action, adjusting the temperature warmer or cooler, to balance energy consumption with occupant comfort.

As shown in FIG. 3, the system may modify the start time for the zone temperature action for an entire floor, zone by zone. Throughout the operation of the system, the temperature in each zone 302 may be allowed to cool down and warm up to optimize comfort conditions. For each zone 302, the system 100 may determine the start time for adjusting the zone temperature, such as activating heating or cooling for the zone, based on multiple zone temperatures and one or more heat transfer characteristics 304. The zone temperature may be measured by a temperature sensor of the zone and may include a zone profile to adjust the zone temperature based on characteristics of the zone. Examples of the heat transfer characteristics include, but are not limited to, zone thermal mass, zone thermal contact to the outside, effect of the heating/cooling system, and contact with other zones. The zone thermal mass may indicate heat retention and sensitivity to temperature fluctuations for the particular zone. Zone thermal contact to the outside 306 indicates the influence of a temperature differential relative to an outside area of the facility. Effect of the heating/cooling system 308, such as zone thermal contact with other zones, indicates the influence of a temperature differential relative to an adjacent area 302 inside of the facility. For some embodiments, the system 100 may determine the start time for the zone temperature action for each zone 302, such as a first zone, based on a first zone temperature of the particular zone, a second zone temperature of another zone (such as an adjacent zone), and one or more heat transfer characteristic associated with these zones.

It is to be understood that, although certain arrows of FIG. 3 represent the transfer of heat from inner areas to each zone and the transfer of heat from zones to the outside area, heat may be transferred in other directions and/or in both directions.

Figure 4:
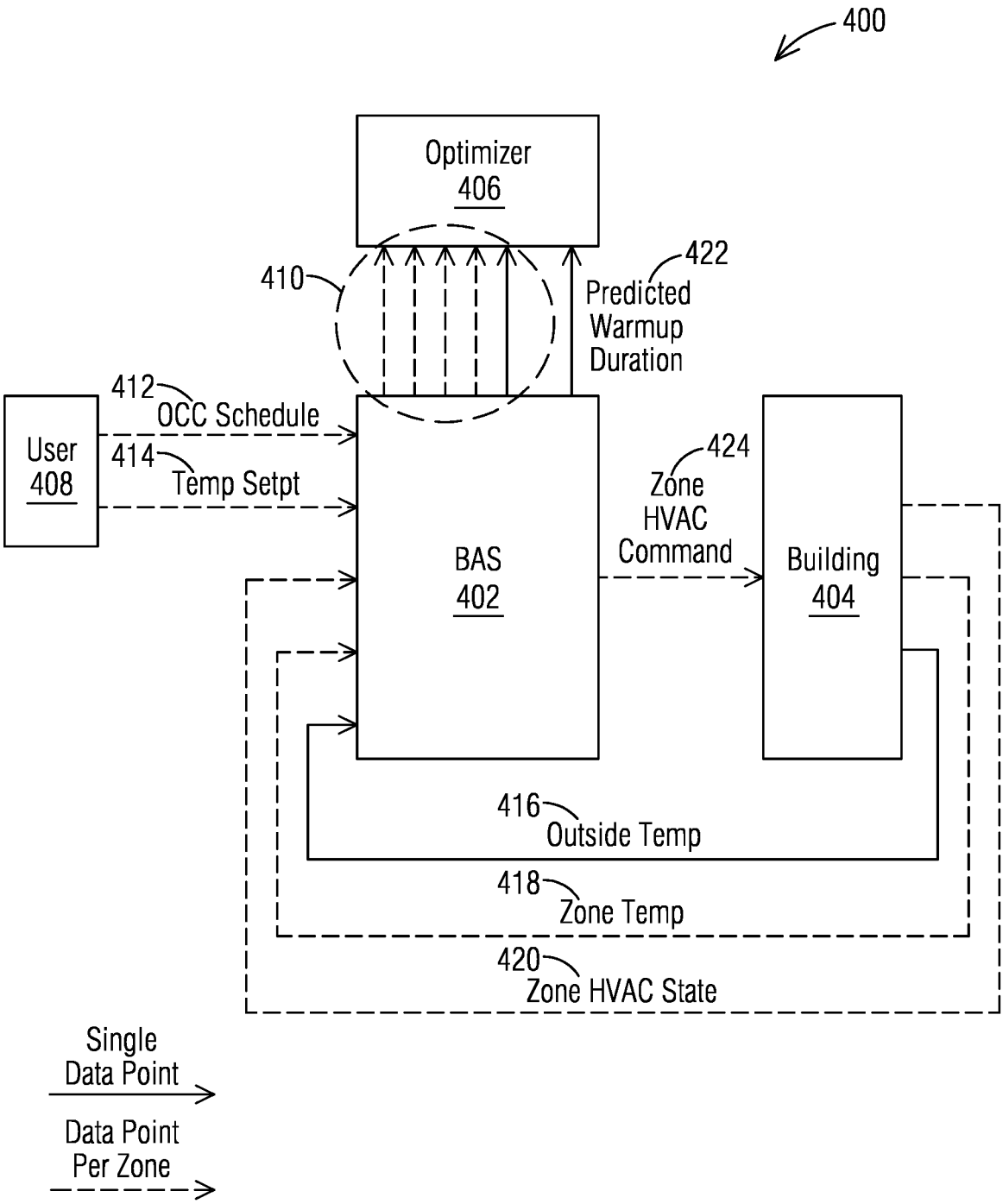
FIG. 4 is a data flow diagram of a building management system in an example implementation that is operable to employ techniques described herein.

Referring to FIG. 4 is a data flow diagram of a building management system 100 in an example implementation that is operable to employ techniques described herein. The environment 400 of the building management system 100 includes a building automation system 402, a facility 404, and an optimizer 406. The environment 400 may also include a user device 408 representing inputs provided by an operator or occupant of the building 404. Although shown in FIG. 4 as separate entities, the various components 402, 406, 408 of the system 100 may be located within the facility 404 or offsite from the facility boundaries.

For some embodiments, the optimizer 406 is trained to identify the heat transfer characteristic by analyzing a first set of the first zone temperature, the second zone temperature, the outside temperature, and known start/non-start conditions. For some embodiments, the trained optimizer 406 is operated to indicate a start signal and/or a non-start signal. The start/non-start indication may be based, at least in part, on a second set of the first zone temperature, the second zone temperature, and the heat transfer characteristic. An example of a start signal is an activation signal for heating and/or cooling, and an example of a non-start signal is a wait/delay signal. For such embodiments, the optimizer 406 may be based on a machine learning model. Examples of the optimizer 406 include, but are not limited to, an artificial neural network, a random forest of decision trees, and the like.

For an optimizer 406 based on machine learning, the model may be replicated to represent a building or part of a building with multiple, separately controlled spaces. For example, the replicated model may support separately optimized warm up for each zone. Conventional systems fail to successfully optimize separate spaces due to their neglect of heat transfer between rooms, which has significant effect on the temperature trend of each room. The system 100, 402 represents a more realistic model which may be implemented in the Cloud. The optimizer 406 of the system 100, 402 determines a start time for a zone temperature action for each zone. Examples of zone temperature actions include, but are not limited to, heating activation, cooling activation, and the like. Examples of start times include, but are not limited to, the latest start for each zone, the start times that warm zones using the least energy, and/or start times with the most favorable utility load profile. The optimizer 406 may be trained with a "reinforcement learning" method to learn about the specific building 404, thus defining a performance function, balancing energy use, and reliably comfortable results. The optimizer 406 observes periodic operation (such as daily) of the full set of zones and learns the thermal characteristics that govern heat transfer between the zones. It uses time dependent data from each zone to learn how they affect each other. This enables accurate calculation of the start time for each zone.

As shown in FIG. 4, the five inputs 410 to the optimizer 406 are similar to the five inputs 412, 414, 416, 418, 420 to the building automation system 402. The building automation system 402 receives an occupant-centric controls schedule signal 412 and a temperature setpoint signal 414 from the user device 408, which rarely change. The building automation system 402 also receives an outside temperature signal 416, a zone temperature signal 418 for each zone, and a zone HVAC state 420 for each zone from the facility 404. These building signals 416, 418, 420 may be time varying signals that would update on a periodic basis. The optimizer 406 receives some or all of these inputs 412, 414, 416, 418, 420 to the building automation system 402 as its own inputs 410, and the optimizer may work with time series data or current values. The optimizer 406 provides signals 422 to the system 402 in which the signal or signals represent one data point per zone. In response to these optimizer inputs 410, the optimizer 406 generates a start signal or a non-start signal, one signal 422 per zone, such as start now or wait. The optimizer 406 provides start/non-start signal 422 to the building automation system 402, and examples of the signal 422 include, but are not limited to, the expected time needed to start the zone or the duration expected for the warmup (or cool down) process. The building automation system 402 sends a zone command 424 to a temperature control system of the facility 404 in which the zone command includes the start time of the zone temperature action for each zone, such as a zone HVAC command representing the start time.

Figure 5:
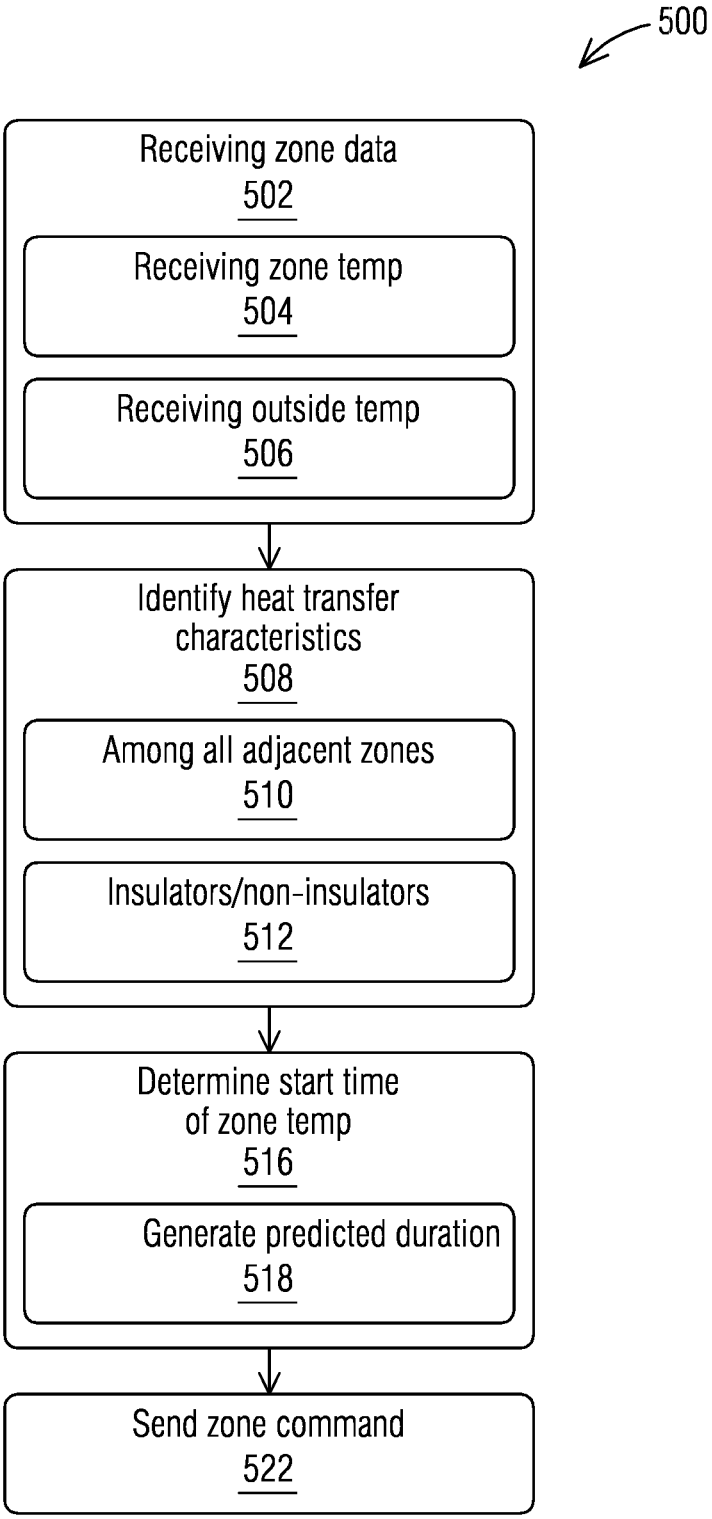
FIG. 5 is a sequential process diagram of an example operation to determine restoration times of comfort conditions.

Referring to FIG. 5 is a sequential process diagram of an example operation 500 to determine restoration times of comfort conditions. The system 100 receives (502) data associated with multiple zones of a facility. For example, the system may receive (504) zone temperatures for zones in which each zone temperature corresponds to a particular zone. For some embodiments, the system 100 receives (506) an outside temperature for an outside area of the facility as well as the zone temperatures for zones in the facility.

In response to receiving (502) the data of the multiple zones, the system 100 identifies (508) a heat transfer characteristic between pairs of adjacent zones of the facility. For example, one of the heat transfer characteristics may be associated with a first zone and a second zone in which the second zone located adjacent to the first zone. For some embodiments, the system 100 may determine (510) the heat transfer characteristics between the first zone and all zones adjacent to the first zone. For some embodiments, the system 100 may identify (512) heat transfer characteristics of insulators and non-insulators in common with the first and second zones. Examples of insulators include, but are not limited to, wall, floors, ceilings, partitions, and closed portals to/from each zone. Examples of non-insulators includes, but are not limited to, vents, passages, open portals, and other openings to/from each zone.

Subsequent to identifying (508) the heat transfer characteristics of adjacent zones and/or in response to receiving (502) the data of the multiple zones, the system 100 determines (516) a start time for a zone temperature action for each zone. For example, the system 100 may determine the start time for a first zone based on a first zone temperature of the first zone, a second zone temperature of the second zone, and the heat transfer characteristic. For embodiments where the outside temperature is known, the system 100 determines the start time for the zone temperature action for the first zone based on the outside temperature. For some embodiments, the system 100 generates (518) a predicted duration for reaching a comfort temperature for the first zone. The system 100 may determine the start time of the zone temperature action based on the predicted duration.

In response to determining (516) the start time, the system 100 sends (522) a zone command to a temperature control system of the facility. The zone command includes the start time of the zone temperature action for the first zone.

Figure 6:
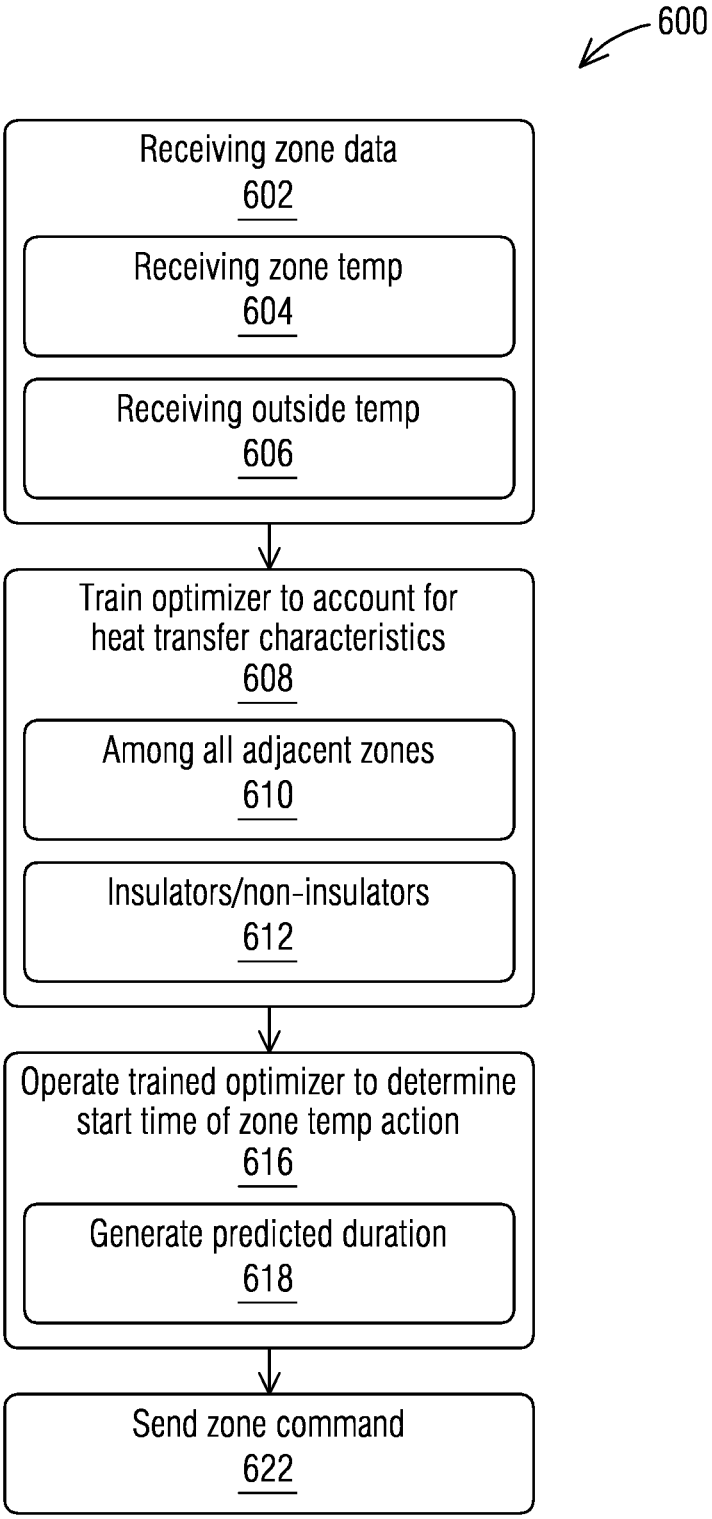
FIG. 6 is a sequential process diagram of another example operation to determine restoration times of comfort conditions.

Referring to FIG. 6 is a sequential process diagram of another example operation 600 to determine restoration times of comfort conditions. The system 100 receives (602) data associated with multiple zones of a facility. For example, the system may receive (604) zone temperatures for zones in which each zone temperature corresponds to a particular zone. For some embodiments, the system 100 receives (606) an outside temperature for an outside area of the facility as well as the zone temperatures for zones in the facility.

In response to receiving (602) the data of the multiple zones, the system 100 determines (608, 616) a start time for a zone temperature action for each zone. For example, the system 100 may determine the start time for a first zone based on a first zone temperature of the first zone, a second zone temperature of the second zone, and the heat transfer characteristic. For embodiments where the outside temperature is known, the system 100 determines the start time for the zone temperature action for the first zone based on the outside temperature. For some embodiments, the system 100 generates (618) a predicted duration for reaching a comfort temperature for the first zone. The system 100 may determine the start time of the zone temperature action based on the predicted duration.

For some embodiments, the system 100 determines (608, 616) a start time for the zone temperature action for each zone using an AI or Machine Learning model. Accordingly, the system 100 trains (608) an optimizer 406 to account for one or more heat transfer characteristics using a first sent of data and operates (616) the trained optimizer 406 to determine the start time for the zone temperature action.

The system 100 trains (608) the optimizer 406 to account for the heat transfer characteristic or characteristics between pairs of adjacent zones of the facility. For some embodiments, the optimizer 406 accounts for the heat transfer characteristic(s) by explicitly estimating physical characteristics such as heat transfer coefficients or resistive values. For some embodiments, the optimizer 406 accounts for heat transfer characteristic(s) by parameterizing a set of mathematical operations so that they behave like the physical thermal system, without estimating identifiable physical characteristics.

For example, one heat transfer characteristics may be associated with a first zone and a second zone in which the second zone located adjacent to the first zone. For some embodiments, the system 100 may determine (610) the heat transfer characteristics between the first zone and all zones adjacent to the first zone. For some embodiments, the system 100 may identify (612) heat transfer characteristics of insulators and non-insulators in common with the first and second zones. For some embodiments, the system 100 may train (608) the optimizer 406 to determine the heat transfer characteristic by analyzing a first set of the first zone temperature, the second zone temperature, and known start/non-start conditions.

Subsequent to training (608) the optimizer 406, the system 100 operates trained optimizer (616) to determine the start time of the zone temperature action. For some embodiments, the system 100 may determine the start time for the zone temperature action by operating the optimizer 406 to indicate a start signal or a non-start signal. The start signal and/or non-start signal may be based, at least in part, on a second set of the first zone temperature, the second zone temperature, and the heat transfer characteristic. For some embodiments, the system 100 generates (618) a predicted duration for reaching a comfort temperature for the first zone. The system 100 may determine the start time of the zone temperature action based on the predicted duration.

In response to determining (616) the start time, the system 100 sends (622) a zone command to a temperature control system of the facility. The zone command includes the start time of the zone temperature action for the first zone.

As referenced above, the optimizer 406 of the system 100 may utilize an artificial intelligence or machine learning ("AI/ML") model to identify heat transfer characteristics and/or determine start time of zone temperatures. The inputs provided to the model are used to discover the infrastructure of the zones of the building and associated heat transfer conditions/thermal characteristics between the zones. The AI/ML model may be trained for an applicable facility to optimize the optimum start sequence of the zones. Once trained, how the AI/ML application may operate to apply the learned optimum start sequence of the rooms and monitor inputs/feedback for particular use cases, such as different season, different weather for the day, etc. For some embodiments, the system 100 may address scalability since the number of zones may be increased in the hundreds or even thousands.

The system of AI/ML application may consume, for example, time series data. Some data may be more relevant than others, such as the temperature of each zone, the HVAC status of each zone (on/off or value), and/or the weather conditions outside (temperature, wind, and/or sun). The AI/ML application may learn values that model behavior of the temperature adjustment process, and learned parameters may represent thermal properties of the facility and associated equipment. The knowledge of the AI/ML application will be based on observing temperature changes from sample to sample, and relating those changes to current temperatures, current HVAC system state, and current outside conditions. The change in temperature for each zone may be strongly or weakly coupled to the temperature of a particular zone, temperatures of adjacent zones, and/or HVAC output in the zone or adjacent zones.

The learning process may operate continuously, using current values and calculated changes. For example, the AI/ML application may accumulate the time series data and process it in larger increments and/or process a full warm-up cycle at once, rather than smaller incremental responses. For some embodiments, the system 100 may collect data, or more data, during significant temperature changes rather than during steady operation. For some embodiments, variations may be inserted into the process that do not occur naturally. For example, the system 100 may distinguish the effects of the various HVAC output on each zone if the start times are artificially separated from each other by determined amounts.

Figure 7:
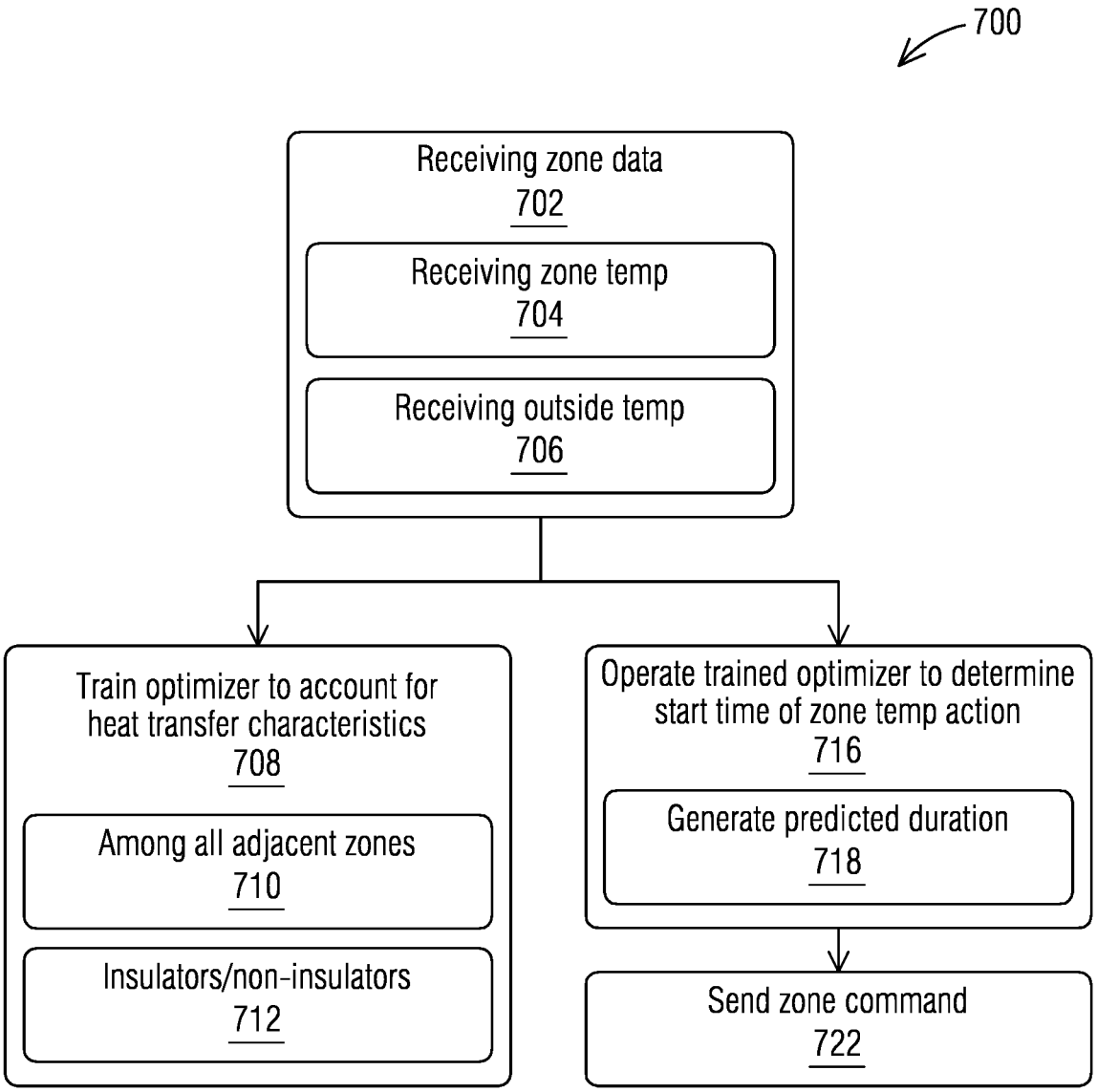
FIG. 7 is a separate, connected process of yet another example operation to determine restoration times of comfort conditions.

Referring to FIG. 7 is a separate, connected process diagram of yet another example operation 700 to determine restoration times of comfort conditions. For this example operation 700, the complete optimizing start/stop process may be understood, designed, or implemented as separable sub-processes. The separate subprocesses may run on different processors and accomplish their functions on different time scales.

In one embodiment, a room temperature control function reads current room temperature data and acts to drive the room temperature toward the current setpoint over a period of minutes and applies warmup duration data to drive the room temperature toward the next scheduled setpoint. The start optimizer receives room temperature data from one or multiple rooms, setpoint schedules, and data representing heat transfer characteristics. The start time optimizer calculates start duration for one or multiple rooms, accomplishing the function on a time scale of, for example, hours or days. The learning process receives room temperature data for one or multiple rooms, possibly receiving values in real-time and accumulating them into time series data structures, or possibly receiving already compiled time series data structures. The learning process calculates data that accounts for heat transfer characteristics in and between rooms and delivers that data in a form the optimizer can apply it to calculate new start duration data. The learning process accomplishes its function over a period of, for example, many days.

The learning process and the optimizer are designed to become more effective as they function. The improvement is measured and guided by a performance evaluator algorithm, also known as a cost function. The cost function quantifies all aspects of "sub-optimal performance." Aspects include warmup accomplished too late and warmup accomplished too early. The first leads to discomfort and dissatisfies occupants. The second consumes more energy than necessary. The aspects are weighted and combined in a single performance indicator. The optimizer and learning process are designed to adapt their own operation in a way that minimizes the cost function over time.

Similar to the example operation 600, the example operation 700 of the system 100 receives (702) data associated with multiple zones of a facility. The system may receive (704) zone temperatures for zones in which each zone temperature corresponds to a particular zone. For some embodiments, the system 100 receives (706) an outside temperature for an outside area of the facility as well as the zone temperatures for zones in the facility.

In contrast to the example operation 600, the example operation 700 distinguishes training and operation as separable sub-processes. In response to receiving (702) the data of the multiple zones, the system 100 determines (708, 716) a start time for a zone temperature action for each zone. In particular, the system 100 determines (708, 716) a start time for the zone temperature action for each zone using an AI or Machine Learning model. The system 100 trains (708) an optimizer 406 to account for one or more heat transfer characteristics using a first sent of data and operates (716) the optimizer 406 to determine the start time for the zone temperature action.

In response to receiving (702) the data of the multiple zones, the system 100 trains (708) the optimizer 406 to account for the heat transfer characteristic or characteristics between pairs of adjacent zones of the facility. For some embodiments, the system 100 may determine (710) the heat transfer characteristics between the first zone and all zones adjacent to the first zone. For some embodiments, the system 100 may identify (712) heat transfer characteristics of insulators and non-insulators in common with the first and second zones.

In response to receiving (702) the data of the multiple zones, in addition to training (708) the optimizer 406, the system 100 also operates (716) the optimizer to determine the start time of the zone temperature action. Generally, the optimizer is to be trained (708) before determining the start time but, for those instances when training has not yet been completed, the optimizer may determine the start time based on defined settings until the optimizer is trained. For some embodiments, the system 100 generates (718) a predicted duration for reaching a comfort temperature for the first zone.

In response to determining (716) the start time, the system 100 sends (722) a zone command to a temperature control system of the facility. The zone command includes the start time of the zone temperature action for the first zone.

Those skilled in the art will recognize that, for simplicity and clarity, the full structure and operation of all data processing systems suitable for use with the present disclosure are not being depicted or described herein. Also, none of the various features or processes described herein should be considered essential to any or all embodiments, except as described herein. Various features may be omitted or duplicated in various embodiments. Various processes described may be omitted, repeated, performed sequentially, concurrently, or in a different order. Various features and processes described herein can be combined in still other embodiments as may be described in the claims.

It is important to note that while the disclosure includes a description in the context of a fully functional system, those skilled in the art will appreciate that at least portions of the mechanism of the present disclosure are capable of being distributed in the form of instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable mediums include nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs).

Although an example embodiment of the present disclosure has been described in detail, those skilled in the art will understand that various changes, substitutions, variations, and improvements disclosed herein may be made without departing from the spirit and scope of the disclosure in its broadest form.

What is claimed is:

1. A building management system for determining restoration times of comfort conditions comprising:

an input component configured to receive a plurality of zone temperatures for a plurality of zones of a facility, the plurality of zones including a first zone and a second zone located adjacent to the first zone;

a processor coupled to the input component, the processor identifying a heat transfer characteristic between the first and second zones, and determining a start time for a zone temperature action for the first zone based on a first zone temperature of the first zone, a second zone temperature of the second zone, and the heat transfer characteristic; and an output component coupled to the processor, the output component sending a zone command to a temperature control system of the facility, the zone command including the start time of the zone temperature action for the first zone.

2. The building management system as described in claim 1, wherein:

the input component receives an outside temperature for an outside area of the facility, and the processor determines the start time for the zone temperature action for the first zone includes determining the start time based on the outside temperature.

3. The building management system as described in claim 1, wherein the processor determines the heat transfer characteristics between the first zone and all zones adjacent to the first zone.

4. The building management system as described in claim 1, wherein the processor identifies heat transfer characteristics of insulators and non-insulators in common with the first and second zones.

5. The building management system as described in claim 1, wherein the processor generates a predicted duration for reaching a comfort temperature for the first zone and determining the start time of the zone temperature action based on the predicted duration.

6. A method for determining restoration times of comfort conditions, the method comprising:

receiving a plurality of zone temperatures for a plurality of zones of a facility, the plurality of zones including a first zone and a second zone located adjacent to the first zone;

identifying a heat transfer characteristic between the first and second zones;

determining a start time for a zone temperature action for the first zone based on a first zone temperature of the first zone, a second zone temperature of the second zone, and the heat transfer characteristic; and sending a zone command to a temperature control system of the facility, the zone command including the start time of the zone temperature action for the first zone.

7. The method as described in claim 6, further comprising receiving an outside temperature for an outside area of the facility, wherein determining the start time for the zone temperature action for the first zone includes determining the start time based on the outside temperature.

8. The method as described in claim 6, wherein identifying the heat transfer characteristic between the first and second zones includes determining the heat transfer characteristics between the first zone and all zones adjacent to the first zone.

9. The method as described in claim 6, wherein identifying the heat transfer characteristic between the first and second zones includes identifying heat transfer characteristics of insulators and non-insulators in common with the first and second zones.

10. The method as described in claim 6, wherein determining the start time of the zone temperature action includes generating a predicted duration for reaching a comfort temperature for the first zone and determining the start time of the zone temperature action based on the predicted duration.

11. A building management system for determining restoration times of comfort conditions comprising:

an input component configured to receive a plurality of zone temperatures for a plurality of zones of a facility, the plurality of zones including a first zone and a second zone adjacent to the first zone;

a processor coupled to the input component, the processor determining a start time for a zone temperature action for the first zone based on a first zone temperature of the first zone, a second zone temperature of the second zone, and a heat transfer characteristic between the first and second zones; and an output component coupled to the processor, the output component sending a zone command to a temperature control system of the facility, the zone command including the start time of the zone temperature action for the first zone.

12. The building management system as described in claim 11, wherein:

the input component receives an outside temperature for an outside area of the facility, and the processor determines the start time for the zone temperature action for the first zone includes determining the start time based on the outside temperature.

13. The building management system as described in claim 11, wherein:

the processor determines the heat transfer characteristics between the first zone and all zones adjacent to the first zone; and the processor determines the heat transfer characteristics of insulators and non-insulators in common with the first and second zones.

14. The building management system as described in claim 11, further comprising an optimizer trained to determine the heat transfer characteristic by analyzing a first set of the first zone temperature, the second zone temperature, and known start/non-start conditions, wherein the trained optimizer is operated to indicate at least one of either a start signal or a non-start signal based, at least in part, on a second set of the first zone temperature, the second zone temperature, and the heat transfer characteristic.

15. The building management system as described in claim 11, wherein the processor generates a predicted duration for reaching a comfort temperature for the first zone and determining the start time of the zone temperature action based on the predicted duration.

16. A method for determining restoration times of comfort conditions, the method comprising:

receiving a plurality of zone temperatures for a plurality of zones of a facility, the plurality of zones including a first zone and a second zone located adjacent to the first zone;

determining a start time for a zone temperature action for a first zone based on a first zone temperature of the first zone, a second zone temperature of the second zone, and a heat transfer characteristic between the first and second zones; and sending a zone command to a temperature control system of the facility, the zone command including the start time of the zone temperature action for the first zone.

17. The method as described in claim 16, further comprising receiving an outside temperature for an outside area of the facility, wherein determining the start time for the zone temperature action for the first zone includes determining the start time based on the outside temperature.

18. The method as described in claim 16, wherein determining the start time for the zone temperature action comprises:

determining the heat transfer characteristics between the first zone and all zones adjacent to the first zone; and determining the heat transfer characteristics of insulators and non-insulators in common with the first and second zones.

19. The method as described in claim 16, wherein determining the start time for the zone temperature action comprises:

training an optimizer to determine the heat transfer characteristic by analyzing a first set of the first zone temperature, the second zone temperature, and known start/non-start conditions; and operating the trained optimizer to indicate at least one of either a start signal or a non-start signal based, at least in part, on a second set of the first zone temperature, the second zone temperature, and the heat transfer characteristic.

20. The method as described in claim 16, wherein determining the start time of the zone temperature action includes generating a predicted duration for reaching a comfort temperature for the first zone and determining the start time of the zone temperature action based on the predicted duration.

* * * * *